US009021843B2

(12) United States Patent
Zuraski et al.

(10) Patent No.: US 9,021,843 B2
(45) Date of Patent: May 5, 2015

(54) HYBRID LOCK CYLINDER

(71) Applicant: Schlage Lock Company LLC, Indianapolis, IN (US)

(72) Inventors: Robert D. Zuraski, Taunton, MA (US); Mary Teresa Carter, Boston, MA (US); Daniel Hugh Kindstrand, Plainville, MA (US); David Bruce Miller, Braintree, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 13/963,968

(22) Filed: Aug. 9, 2013

(65) Prior Publication Data

US 2014/0053621 A1 Feb. 27, 2014

Related U.S. Application Data

(60) Provisional application No. 61/681,541, filed on Aug. 9, 2012.

(51) Int. Cl.
*E05B 29/04* (2006.01)
*E05B 29/00* (2006.01)

(52) U.S. Cl.
CPC ..... *E05B 29/0033* (2013.01); *E05B 29/0013* (2013.01); *E05B 29/0066* (2013.01)

(58) Field of Classification Search
USPC ..... 70/358, 366, 375, 492, 495, 419, 421, 70/365
See application file for complete search history.

(56) References Cited

U.S. PATENT DOCUMENTS

| | | | | | |
|---|---|---|---|---|---|
| 2,155,440 | A | * | 4/1939 | Olson | 70/358 |
| 2,358,164 | A | * | 9/1944 | Honger | 70/342 |
| 2,524,339 | A | * | 10/1950 | Young et al. | 70/366 |
| 2,587,739 | A | * | 3/1952 | Kunz | 70/375 |
| 3,260,080 | A | * | 7/1966 | Wellekens | 70/492 |
| 3,509,749 | A | * | 5/1970 | Arzig et al. | 70/492 |
| 4,267,717 | A | | 5/1981 | Martikainen | |
| 4,512,166 | A | | 4/1985 | Dunphy et al. | |
| 4,667,493 | A | | 5/1987 | Takahashi | |
| 4,796,447 | A | * | 1/1989 | Rabinow | 70/495 |
| 4,961,333 | A | * | 10/1990 | Rabinow | 70/495 |

(Continued)

FOREIGN PATENT DOCUMENTS

| | | |
|---|---|---|
| EP | 0212468 | 8/1986 |
| EP | 0712979 A1 | 5/1996 |

(Continued)

OTHER PUBLICATIONS

International Search Report for PCT/US2013/054431 dated Jan. 16, 2014; International Searching Authority (2 pages).

(Continued)

*Primary Examiner* — Lloyd Gall
(74) *Attorney, Agent, or Firm* — Krieg DeVault LLP

(57) ABSTRACT

An exemplary lock assembly includes a plurality of discs, one or more wafer housings housing one or more wafers, a spindle, a locking bar, and a lock assembly housing. Each wafer housing is provided with one or more wafers that are spring biased in a first direction. The discs, wafer housing, and wafers may include recesses. When no key is inserted, the lock assembly is locked by both the wafers and the locking bar. When a proper key is utilized, the locking bar is free to move into the recesses to release the spindle.

2 Claims, 6 Drawing Sheets

(56) References Cited

U.S. PATENT DOCUMENTS

| | | | | |
|---|---|---|---|---|
| 5,544,509 | A * | 8/1996 | Mielonen | 70/366 |
| 6,058,751 | A * | 5/2000 | Dimig et al. | 70/419 |
| 6,584,819 | B1 * | 7/2003 | Hung | 70/491 |
| 7,530,246 | B2 * | 5/2009 | Yang | 70/492 |
| 7,665,333 | B2 | 2/2010 | Shabtay et al. | |
| 7,980,105 | B2 * | 7/2011 | Yang | 70/375 |
| 8,074,480 | B2 | 12/2011 | Huang | |
| 8,091,393 | B2 | 1/2012 | Damikolas et al. | |
| 8,117,876 | B2 | 2/2012 | Mathachan | |
| 8,347,678 | B2 | 1/2013 | Chong | |
| 8,424,349 | B2 | 4/2013 | Marcelle et al. | |
| 2003/0019263 | A1 * | 1/2003 | Chen | 70/366 |
| 2005/0061042 | A1 * | 3/2005 | Lin | 70/492 |
| 2006/0048554 | A1 | 3/2006 | Keller | |
| 2008/0022734 | A1 | 1/2008 | McDaid et al. | |
| 2010/0050718 | A1 * | 3/2010 | Boesel et al. | 70/495 |
| 2011/0265526 | A1 | 11/2011 | Zuraski | |
| 2013/0067972 | A1 | 3/2013 | Buhl | |

FOREIGN PATENT DOCUMENTS

| | | |
|---|---|---|
| EP | 2085542 | 1/2009 |
| EP | 2360333 | 2/2011 |
| JP | 2007-278016 A | 10/2007 |

OTHER PUBLICATIONS

Written Opinion of the International Searching Authority for PCT/US2013/054431 dated Jan. 16, 2014; International Searching Authority (4 pages).

* cited by examiner

HYBRID LOCK CYLINDER

BACKGROUND

The disclosed embodiments generally pertain to locks, and particularly to lock cylinder mechanisms using wafers and wafer housings.

SUMMARY

An embodiment of the present invention increases the security of a disc-style lock by using one of the rotating discs to house coded sliding components. This lock is very difficult to pick because the thief has to defeat both systems that each require different picking techniques.

Another embodiment also provides the advantage of holding onto the key until the key has returned to its starting position. This ensures the opening in discs are realigned before the key is removed.

An additional anti-pick feature is included on the wafers. One of the wafers in each product would have an anti-pick notch that would catch on the edge of the housing during pick attempts.

BRIEF DESCRIPTION OF THE ILLUSTRATIONS

Embodiments of the invention are illustrated in the following illustrations.

DETAILED DESCRIPTION

Figure 6:
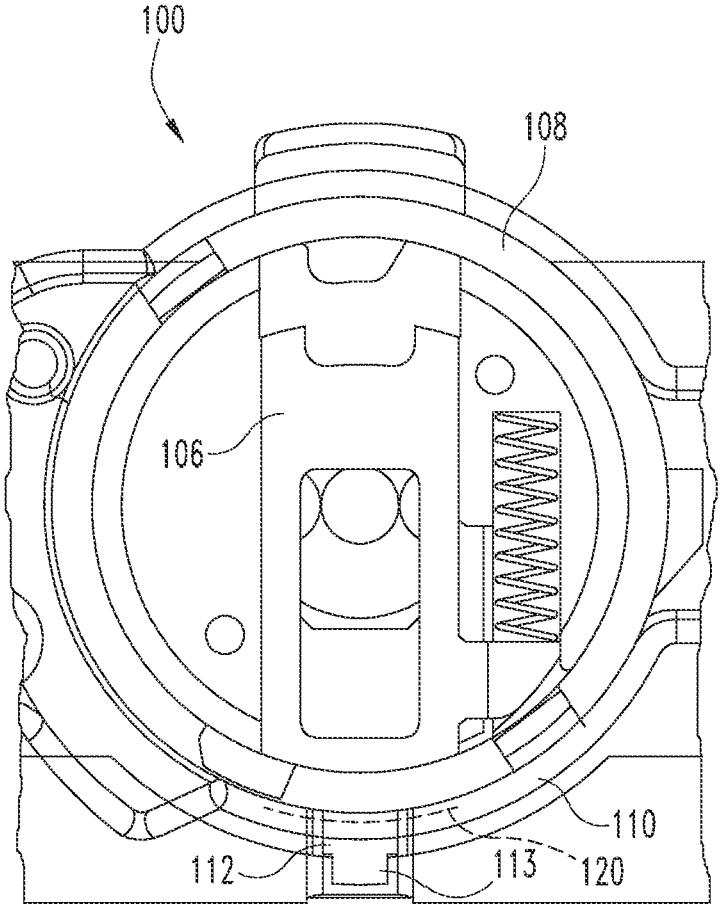
FIG. 6 depicts an additional anti-pick feature in which a wafer has a first extension member and another narrower extension member extending therefrom.

Referring now to FIGS. 1-5, a lock assembly 100 is provided with a plurality of discs 102, one or more wafer housings 104 housing one or more wafers 106, a spindle 108, a locking bar 109, and a lock assembly housing 110 (see FIG. 6). The locking bar 109 is positioned in a channel 118 formed in the spindle 108, and is operable to selectively prevent rotation of the spindle 108 with respect to the housing 110. Each wafer housing 104 is provided with one or more wafers 106 that are spring 107 biased in a first direction. The wafers 106 are further provided with one or more first extension members 112 at a first wafer end, and one or more second extension members 114 at a second wafer end.

Figure 1:
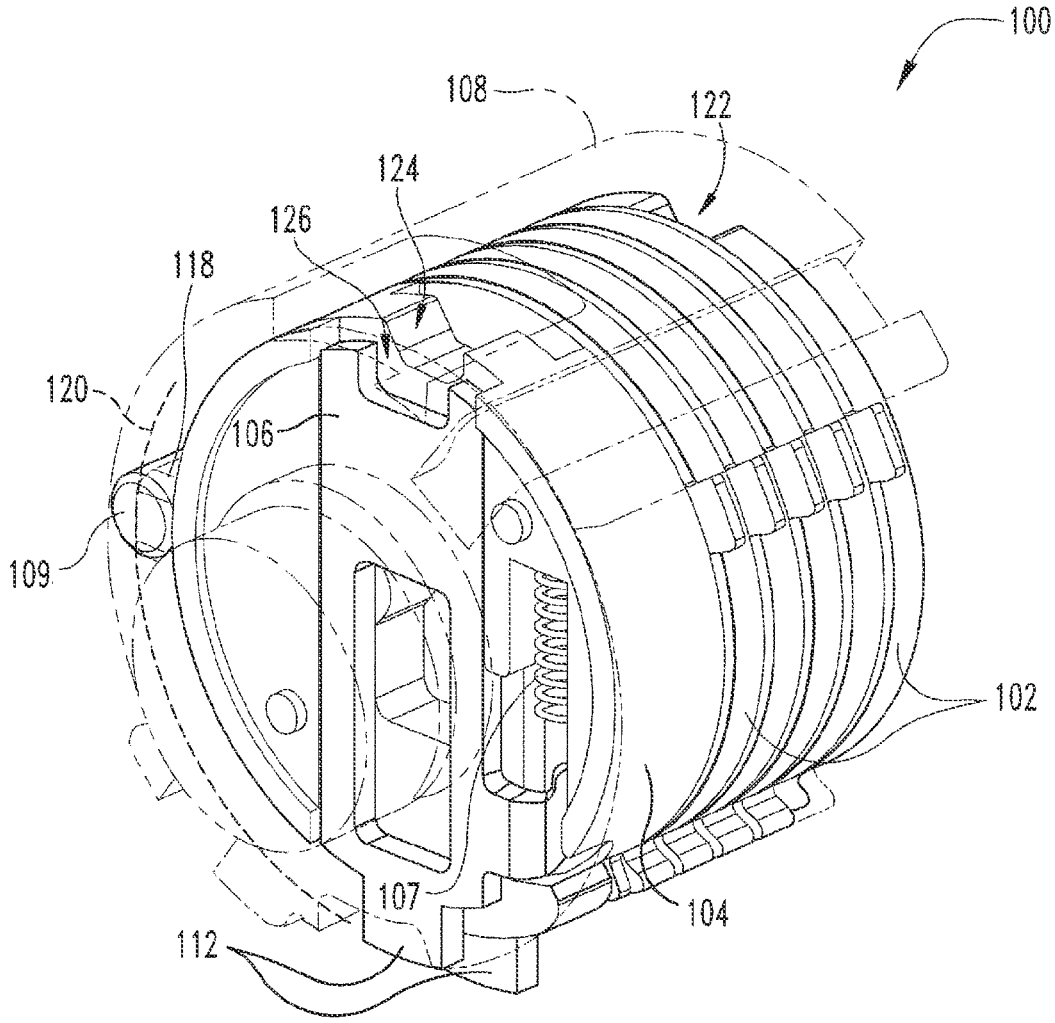
FIG. 1 illustrates a lock assembly in a first configuration with no key inserted.

Referring to FIG. 1, no key is in the lock assembly 100 and the wafers 106 are spring 107 biased such that the first extension members 112 extend through the spindle 108 and into a housing 110 (see FIG. 6). Additionally, the locking bar 109 crosses the shear line 120, preventing rotation of the spindle 108 with respect to the housing 110. Outer surfaces of the discs 102 and the wafer housing 104 prevent the locking bar 109 from moving radially inward. In such a configuration, the lock assembly 100 is locked by both the wafers 106 and the locking bar 109.

Figure 2:
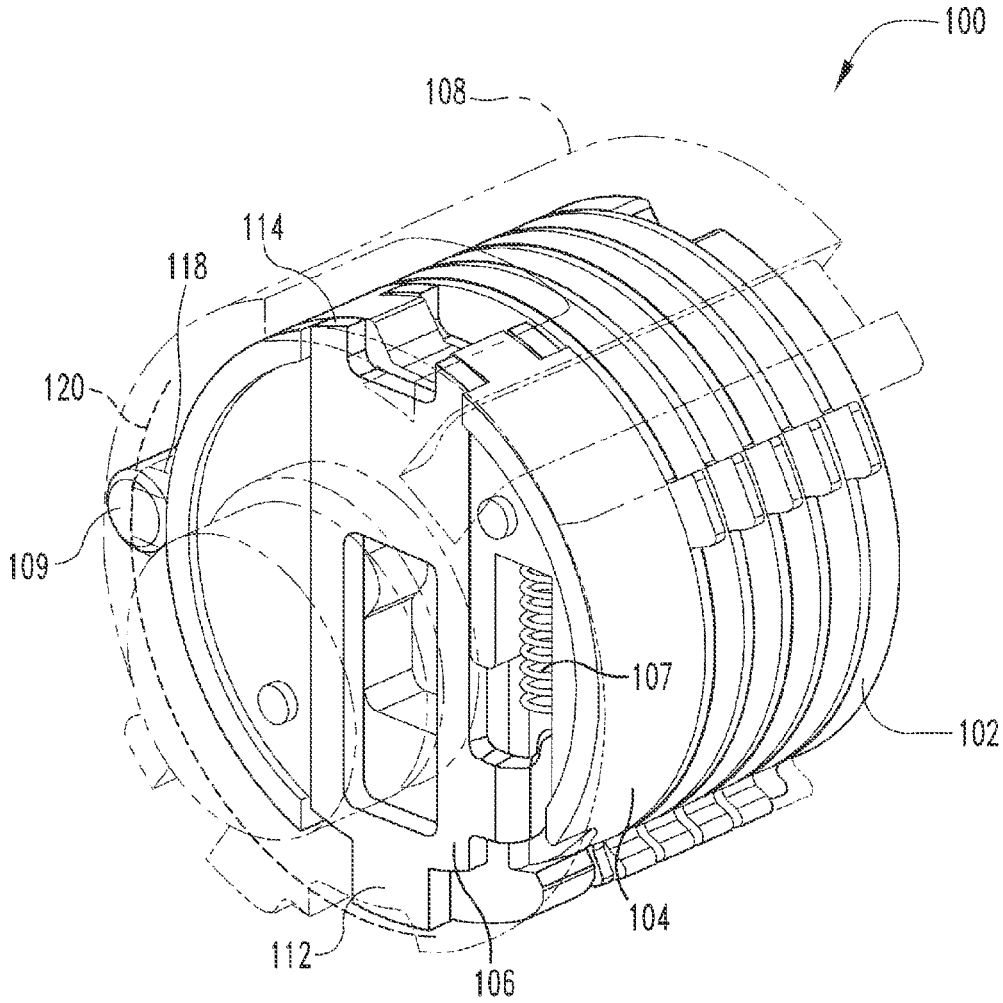
FIG. 2 shows the lock assembly of FIG. 1 in a second configuration with a correct key inserted but not yet turned.

Referring to FIG. 2, a key 200 (see FIG. 5) is inserted in the lock assembly 100. The key 200 is provided with a ramped surface 202 (see FIG. 5) that pushes against the spring bias of the wafer 106 such that the first extension members 112 are pulled from the spindle 108 and the lock assembly housing 110, and is pulled within the wafer housing 104. This allows the wafer extension members 112 to align with the lock shear line 120 and allows the wafer housing 104 to rotate much like the other discs 102. However with the key 200 merely inserted, the outer surfaces of the discs 102 retain the locking bar 109 in the locking position, such that the lock assembly 100 is still locked by the locking bar 109.

Figure 3:
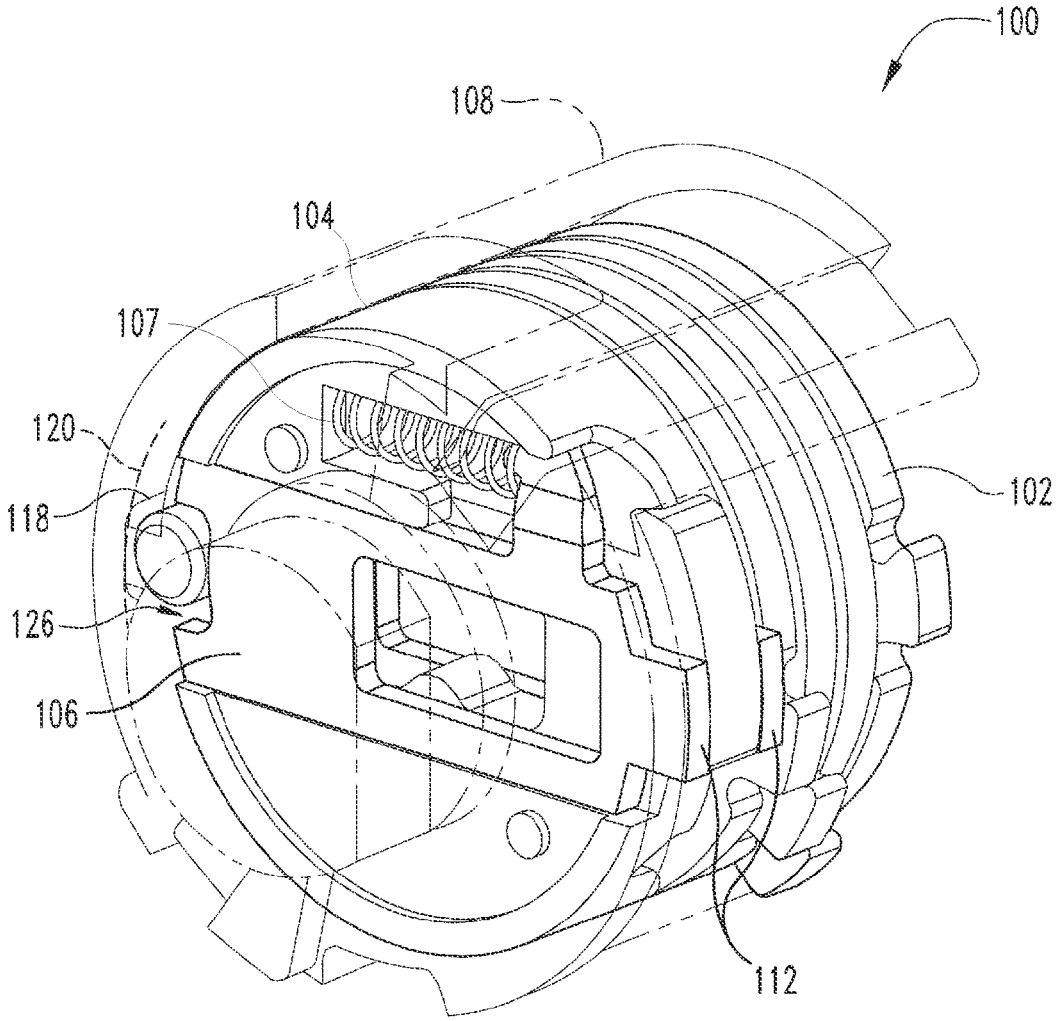
FIG. 3 depicts the lock assembly of FIG. 1 in a third configuration in which a correct key has been inserted and turned the lock assembly.

Referring now to FIG. 3, the lock assembly 100 is shown in a configuration in which a correct key has been inserted and unlocked the lock assembly. Recesses 122, 124, 126 in the discs 102, wafer housing 104, and wafers 106 line up and the locking bar 109 can drop into the wafer recesses and release the spindle 108. That is to say, when the disc recesses 122, wafer housing recesses 124, and wafer recesses 126 are aligned with the locking bar 109, the locking bar 109 can be received by the recesses. Thus, the locking bar 109 is free to travel radially inward to a position in which it no longer crosses the shear line 120. When the locking bar 109 does not cross the shear line 120, the spindle 108 is free to rotate with respect to the housing 110.

Figure 4:
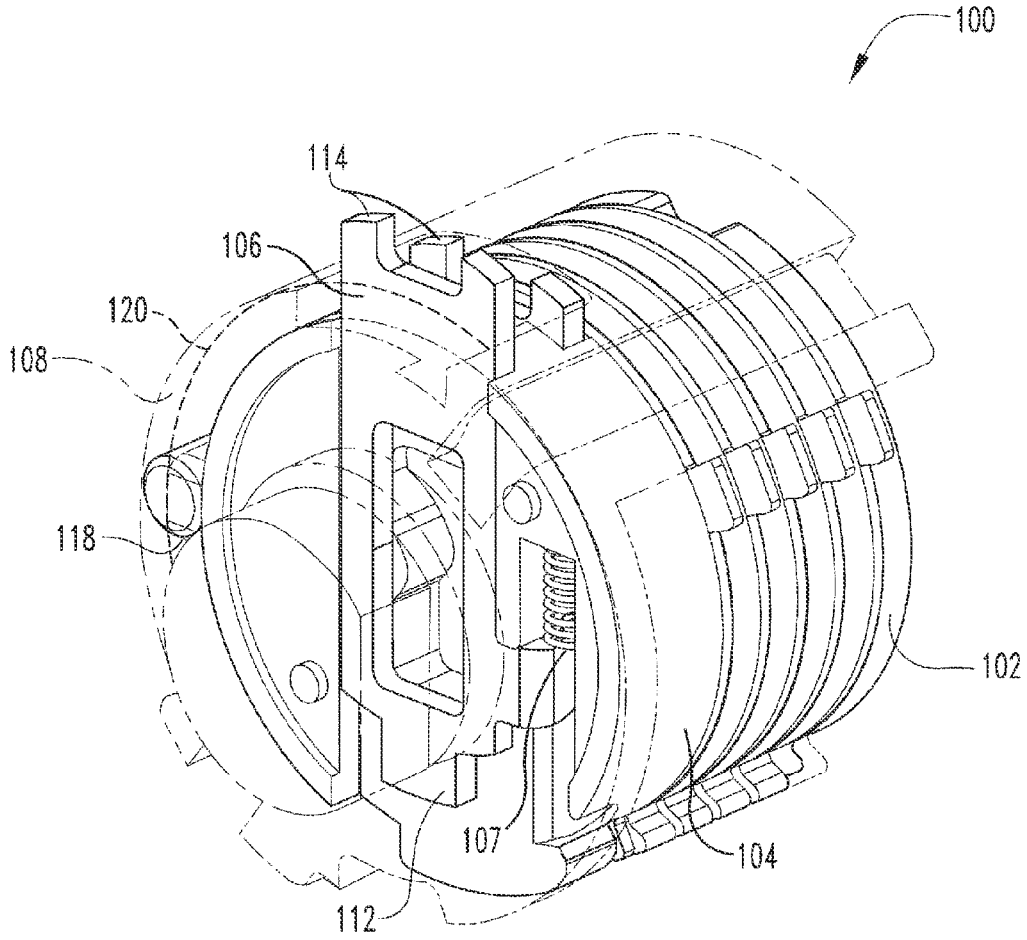
FIG. 4 illustrates the lock assembly of FIG. 1 in which an incorrect key has been inserted or an attempt to pick is being made.
Figure 5:
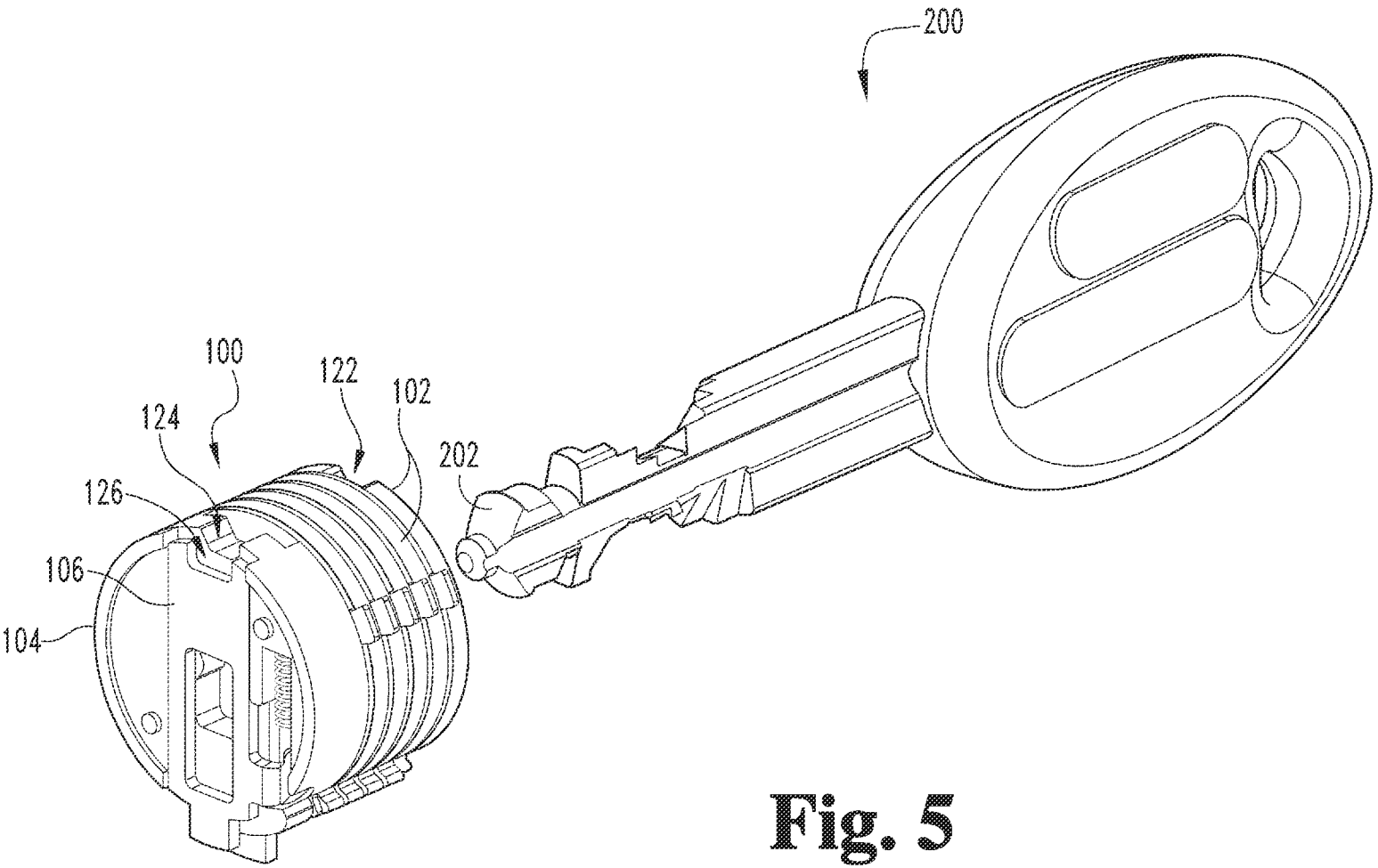
FIG. 5 shows a lock assembly and a typical key for the lock assembly.

Referring now to FIG. 4, should an incorrect key be inserted that would otherwise allow the first wafer extension members 112 to clear the shear line 120 of the lock assembly 100, second wafer extension members 114 then extend out of the wafer housing 104 and into the spindle 108 and/or the lock assembly housing 110. Thus, preventing the wafer housing 104 from rotating.

Referring now to FIG. 6, one wafer 106 in a lock assembly 100 may have a first extension member 112 provided with another narrower extension member 113 extending therefrom. This gives a lock picker a false sense that the wafer has cleared the shear line 120, when it in fact has not.

The lock assembly 100 may incorporate multiple independent sliding components inside of a disc. Various sizes of wafers can be used to increase the number of key codes available. The wafer housing turns as soon as the key turns and accepts the locking bar similar to a traditional disc.

The foregoing written description of structures and methods has been presented for purposes of illustration. Examples are used to disclose the invention, including the best mode, and also to enable any person skilled in the art to practice the invention, including making and using any devices or systems and performing any incorporated methods. These examples are not intended to be exhaustive or to limit the invention to the precise steps and/or forms disclosed, and many modifications and variations are possible in light of the above teaching. Features described herein may be combined in any combination. Steps of a method described herein may be performed in any sequence that is physically possible. The patentable scope of the invention is defined by the appended claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A lock assembly, comprising:

a lock housing;

a spindle positioned in the lock housing;

a locking bar positioned at least partially in the spindle and having a first position wherein the locking bar crosses a shear line of the lock assembly;

a wafer housing seated in the spindle, the wafer housing including a recess sized and configured to receive a portion of the locking bar; and a wafer housed by the wafer housing, wherein the wafer is biased to a first position wherein the wafer extends into the lock housing and prevents rotation of the spindle and the wafer housing, and wherein the wafer is movable to a second position wherein the wafer housing is rotatable; and wherein when the recess is aligned with the locking bar, the locking bar is movable to a second position wherein the locking bar does not cross the shear line.

2. A lock assembly, comprising:

a lock housing;

a spindle positioned in the lock housing, the spindle including a channel, wherein a shear line of the lock assembly is defined between the lock housing and the spindle;

a locking bar positioned at least partially in the channel, the locking bar has a locking position wherein the locking bar crosses the shear line and an unlocking position wherein the locking bar does not cross the shear line;

a disc positioned in the spindle, the disc including a first recess;

a wafer housing positioned in the spindle, the wafer housing including a second recess; and a wafer slidingly coupled to the wafer housing, the wafer having a first position wherein the wafer extends from the wafer housing and prevents rotation of the wafer housing, and wherein the wafer has a second position wherein the wafer does not prevent rotation of the wafer housing; and wherein the locking bar is retained in the locking position when misaligned with at least one of the first and second recesses; and wherein the locking bar is free to move to the unlocking position when aligned with each of the first and second recesses.

* * * * *